US006019379A

United States Patent [19]

DeMarchi

[11] Patent Number: 6,019,379

[45] Date of Patent: Feb. 1, 2000

[54] IN-LINE ROLLER SKATE HAVING A BRAKING DEVICE WITH AMPLIFIED TRAVEL

[75] Inventor: Jean-Louis DeMarchi, Saint-Jorioz, France

[73] Assignee: Salomon S.A., Metz-Tessy, France

[21] Appl. No.: 08/864,083

[22] Filed: May 28, 1997

[30] Foreign Application Priority Data

Jun. 4, 1996 [FR] France ..... 96.07028

[51] Int. Cl.[7] ..... A63C 17/14

[52] U.S. Cl. ..... 280/11.2; 188/5

[58] Field of Search ..... 280/11.2, 11.19, 280/11.22, 11.23, 11.26; 188/5, 6, 7

[56] References Cited

U.S. PATENT DOCUMENTS

| | | | |
|---|---|---|---|
| 5,462,296 | 10/1995 | Pozzobon | 280/11.2 |
| 5,465,984 | 11/1995 | Pelligrini, Jr. et al. | 280/11.2 |
| 5,486,012 | 1/1996 | Olivieri | 280/11.2 |
| 5,653,454 | 8/1997 | Chin | 280/11.2 |
| 5,655,783 | 8/1997 | Brosnan | 280/11.2 |
| 5,702,113 | 12/1997 | Gonella | 280/11.2 |

FOREIGN PATENT DOCUMENTS

| | | |
|---|---|---|
| 0585764 | 3/1994 | European Pat. Off. . |
| 0681856 | 11/1995 | European Pat. Off. . |
| 0681857 | 11/1995 | European Pat. Off. . |
| 3820642 | 12/1989 | Germany . |

*Primary Examiner*—Christopher P. Ellis
*Assistant Examiner*—Bridget Avery
*Attorney, Agent, or Firm*—Greenblum & Bernstein, P.L.C.

[57] ABSTRACT

Roller or in-line roller skate including a boot associated with an upper plate of a frame on which the skating wheels are arranged, and having a braking device constituted of a friction element connected to activating mechanism interposed between a journalled rear portion of the boot and the friction element, so as to bring the latter into a frictional contact with the ground, in view of a braking during a rearward rocking of said journalled portion of the boot, caused by the skater, wherein the friction element is connected to the activating mechanisms via amplification mechanisms that are capable of increasing its travel with resect to that of the activating mechanism.

20 Claims, 1 Drawing Sheet

IN-LINE ROLLER SKATE HAVING A BRAKING DEVICE WITH AMPLIFIED TRAVEL

BACKGROUND OF THE INVENTION

1. Field of the Invention

The present invention relates to a roller or in-line roller skate including a boot whose sole is associated with an upper plate of a frame on which the skating wheels are arranged.

2. Background and Material Information

Such skates are usually equipped with a braking device, both to be able to meet safety requirements and make it possible to perform certain figure skating or acrobatic maneuvers.

Thus, it is generally provided to position a fixed friction element affixed to a rear portion of the frame and being capable of entering into a rubbing, or frictional contact with the ground, in view of an efficient braking, through an action caused by the skater to lift the front wheels.

Brakes of this type are very efficient for undertaking an emergency stop.

Based on the same principle, there are also devices, as described, for example, in European patent applications No. 681 856 and No. 681 857, U.S. Pat. No. 5,465,984 wherein the friction brake is journalled on the frame and is activated by an arm connected to a journalled collar of the boot.

In this case, the skater, with a rearward inclination movement of his leg, pushes the braking block against the ground by means of the connecting arm, while maintaining all the skate wheels on the ground.

Experience has shown that to facilitate the use for a beginner, it was necessary to arrange the friction element as close as possible to the ground because the amplitude of displacement allowed by the collar is limited, either by construction, or by the skater himself as a function of his ability.

This has led the manufacturers of skates equipped with this type of brake, to slant or bevel the lateral edges of the friction elements so that the skater is not subject of ill-timed brake shocks when inclining his skate during the pushing phase or in the curves.

It is easy to understand the very harmful consequences of such a fact, which, in addition, results in a decrease in the braking surface caused by the lateral beveling imparted to the friction element.

SUMMARY OF THE INVENTION

The object of the present invention is to remedy these disadvantages, by proposing a braking device wherein the friction element can be as far as possible from the ground during the resting phase and allow it to offer a greater braking surface, with respect to the prior art wherein its proximity to the ground necessitated the slants imparted to these lateral edges, as mentioned above.

To this end, the invention relates to a roller or in-line roller skate including a boot whose sole is associated with an upper plate of a frame on which the skating wheels are arranged, and having a braking device constituted of a friction element connected to an arm of member of a activating mechanism interposed between a journalled rear portion of the boot and the friction element, so as to place the latter into a frictional contact with the ground, in view of an efficient braking during rearward rocking of the journalled portion of the boot, caused by the skater, wherein the friction element is connected to the activating via an amplification mechanism being capable of increasing its travel with respect to that of the activating member.

In a preferred embodiment, the amplification ratio by which the magnitude of movement of the friction element is increased, with respect to that of the activation member, is constant.

BRIEF DESCRIPTION OF DRAWINGS

The present invention also relates to the characteristics which will become apparent along the description that follows, and which are to be considered separately or according to all of their possible technical combinations.

This description, which is provided by way of non-limiting example, will help to better understand how the invention can be embodied, with reference to the annexed drawings, in which.

DETAILED DESCRIPTION OF THE PREFERRED EMBODIMENTS

Figure 1:
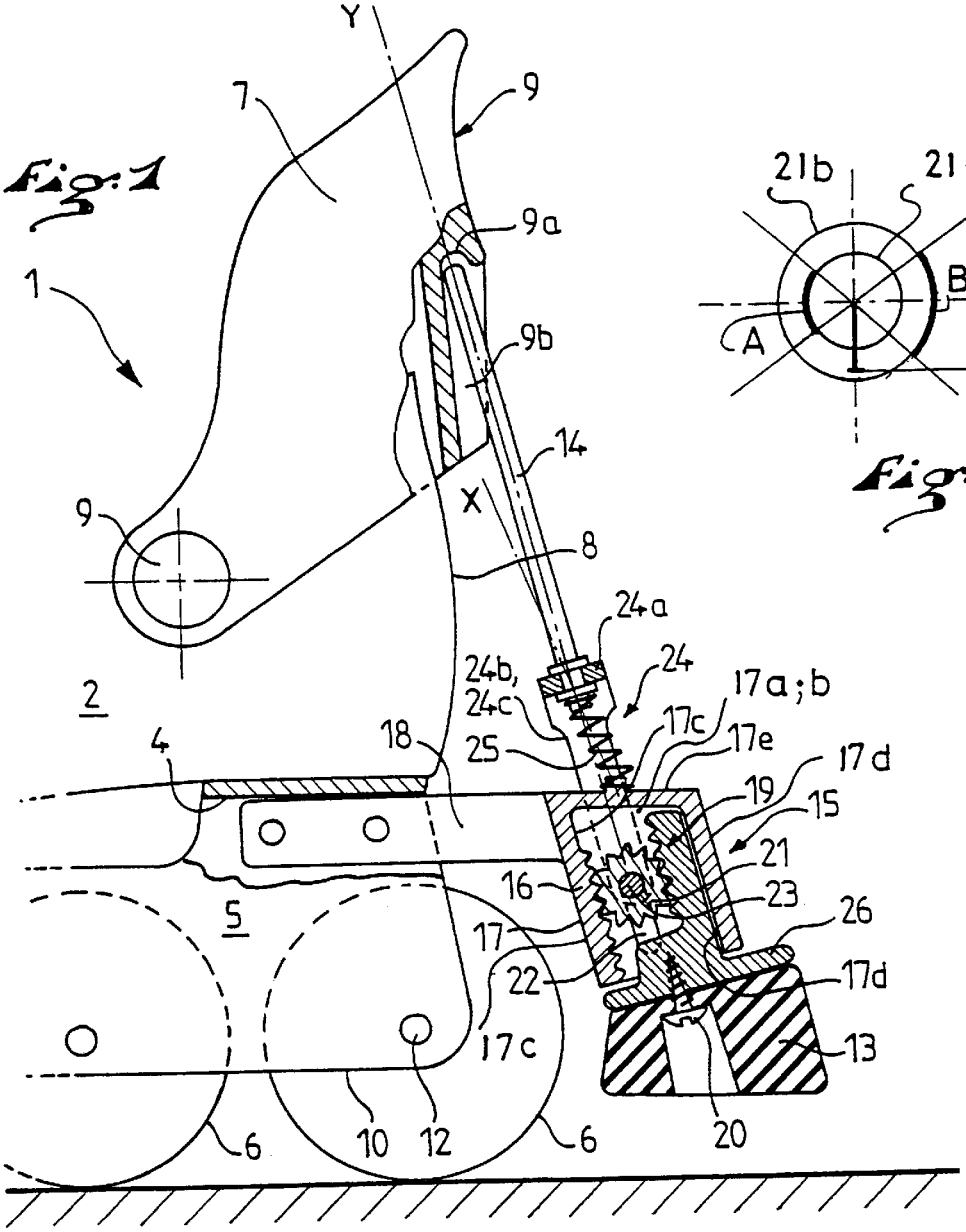
FIG. 1 is a partial cross-sectional lateral view of a rear portion of an in-line roller skate having a braking device with amplified travel, according to the invention, shown in a resting position.

The in-line roller skate, generally designated by the reference numeral 1 and partially shown in FIG. 1, includes a boot 2 adapted to be affixed to the upper plate 4 of a frame 5 on which the wheels 6 are arranged. In the example shown, the boot has a shell 8 covering the entire foot and extended in the direction of the skater's ankle by a journalled portion 7 surrounding the skater's ankle, such journal on the shell 8 occurring by means of an axis 9.

The shell 8 of the boot 2 is affixed to the horizontal upper plate 4 of the frame 5 by known fastening means which are not shown in the drawings, such as screws.

The frame 5 also includes a lower portion perpendicular to the upper 4, along a longitudinal axis, constituted for example of two vertical lateral wings 10 which are parallel to one another and arranged both sides of the longitudinal axis.

Lateral wings 10 are respectively extended at their upper portions by a perpendicular return, each being directed outwardly and constituting a plane corresponding the horizontal plate 4.

In this manner, the vertical lateral wings 10 generally define, together with the sole 3 of the boot 2, an inverted U between the wings of which a plurality of wheels 6 are arranged, for example, as many as four, via the transverse journal axes 12, affixed to the frame 5, in order to constitute a rolling racks.

Such a skate has a braking device constituted of a friction element 13 connected to an activating mechanism 14 constituted by an arm or member interposed between a journalled rear portion 7 of the boot 2 and the friction element 13, so as to place the latter into a frictional contact with the ground, in view of an efficient braking during a rearward rocking of the journalled portion 7 of the boot 2 caused by the skate.

According to a general definition of the invention, the friction element 13 is connected to the activating mechanisms 14 via amplification mechanisms generally designated by the reference numeral 15 and capable of increasing the travel of the friction element 13 with respect to the travel of the activating mechanism 14, without increasing the amplitude of the movement of the latter, and therefore without increasing the amplitude of the movement of the collar activated by the skater. Therefore, the invention makes it possible to improve the braking effect without requiring a greater rearward rocking of the ankle from the user, which could be detrimental to the balance of the user.

According to the presently described embodiment shown in FIG. 1, this mechanism 15 for amplifying the travel of the friction element 13 are constituted by a reducing system including on the one hand, a fixed rack 16 fused to an internal wall of a casing 7, open at its lower portion and affixed to a rear portion of the frame 5 by means of a fastening lug 18 extending rearwardly with respect to the frame. On the other hand, the reducing system includes a mobile, or movable rack 19 affixed to the friction element 13 by means of a fastening screw 20. The mobile rack 19 is housed in the casing 17 facing the fixed rack 16.

The displacement of the friction element 13 driven, towards the ground, in view of a braking action, is carried out by means of a driving pinion 21 interposed between the fixed rack 16 and the mobile rack 19.

The driving pinion 21 is controlled in translation between the fixed rack 16 and the mobile rack 19 by means of the arm 14, at the free end of which it is affixed, and which is connected to the journalled portion 7 of the boot 2. In this manner, the mobile rack 19, and thus the friction element 13, is driven with respect to the fixed rack 16, and thus with respect to the frame 5, according to a value that is equal to that of the travel of the linking arm 14, to which that of the supplemental travel of the mobile rack 19, caused by the pinion 21 borne by the arm 14, is added.

Furthermore, the casing 17 has a four-edged section and includes on each of its faces 17*a*, 17*b*, perpendicular to the faces 17*c*, 17*d*, bearing the fixed 16 and mobile 19 racks, respectively, an elongated guiding opening 22 having an axle 23 affixed to the end of the linking arm 14, and on which the driving pinion 21 is rotatably mounted. Therefore, the rotation of the pinion 21 on the fixed rack 16, causes the displacement in translation of the mobile rack 19.

Still according to the present example of embodiment, the end of the linking arm 14 is connected to the horizontal arm 24*a* of U-shaped fork 24 externally overlapping the closed upper portion 17*e* of the casing 17, and in which the free ends of its two vertical arms 24*b*, 24*c*, constitute rotation bearings for the axle 23 of the driving pinion 21.

The fork 24, therefore, provides the connection between the linking arm 24 and the driving pinion 21.

According to another characteristic of the invention, an elastic return member 25 of the friction element 13, in the initial position after a braking, is interposed between the horizontal arm 24*a* of the U-shaped fork 24 and the upper end 17*e* of the casing 17.

Preferably, the elastic return member 25 is a compression spring.

According to another characteristic of the invention, the longitudinal X, X' axis of the elastic return member is offset in the direction of the journalled portion 7 of the boot 2 with respect to the Y, Y' axis of the linking arm 14 so as to ensure the support thereof against the journalled portion 7.

Still according to the presently described embodiment, the mobile rack 19 is connected to the friction element 13 by means of a support plate 26, whose surface is at least equal to the transverse section of the casing 17 and on the open lower end of which it comes in abutment in an inactive position.

According to the present embodiment, and as well shown in FIG. 1, the driving pinion 21 of the mobile rack 19, with respect to the fixed rack 16, is constituted of a single drum that is longitudinally toothed according to a constant diameter and extends between two faces 17*a*, 17*b* of the casing 17, along a Z, Z' axis (see FIG. 3), parallel to the racks 16, 19, which include a toothing corresponding to that of the pinion 21.

Of course, the toothing of the pinion 21 and of the racks 16 and 19 is calculated for a given and predetermined constant reduction.

Figure 2:
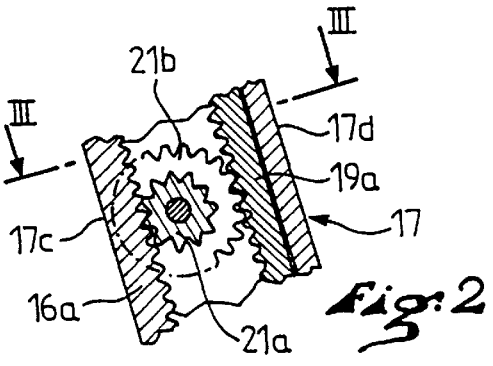
FIG. 2 is a detailed cross-sectional view of the amplification travel device according to another embodiment.
Figure 3:
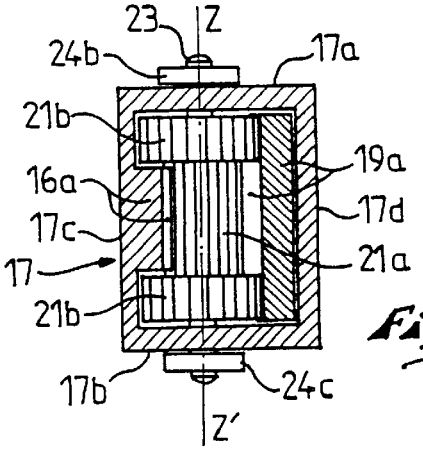
FIG. 3 is a transverse cross-sectional view along the line III—III of FIG. 2.

According to the examples of FIGS. 2 and 3, the driving pinion 21*a*, 21*b* of the mobile rack 19*a*, with respect to the fixed rack 16*a*, is constituted of a double drum including a toothed central portion 21*a*, with a reduced diameter with respect to the diameters of the two equally toothed end portions 21*b*, the central portion 21*a* cooperating with a corresponding portion of the fixed rack 16*a* of the casing 17 and the end portions 21*b* cooperating with corresponding portions of a mobile rack 19*a* affixed to the friction element 13, so as to obtain a greater reduction ratio than that obtained with a pinion having a single toothing of a constant diameter, as previously described in the example of FIG. 1.

Figure 4:
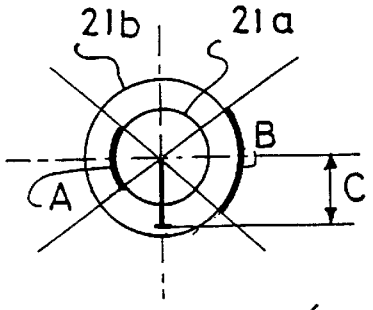
FIG. 4 schematically shows the amplification of a given travel, based on the device according to FIGS. 2 and 3.

FIG. 4 shows well this increased reduction, wherein one sees that according to a distance C corresponding to the travel ratio of the linking arm 14, and causing the rotation A of the portion of the pinion with a small diameter 21*a*, one obtains a displacement B of the portion of the pinion with a large diameter 21*b*, and thus the displacement of the mobile rack 19*a*. That is the travel of the friction element 13 is equal, not to the value of A (which is equivalent to the value of C) corresponding to the travel of the linking arm 14, but to the sum of the A+B values. According to the invention, this is, in fact, an amplified path.

Of course, the double drum construction of the driving pinion could be reversed without leaving the scope of the present invention.

The instant application is based upon the French Priority patent application No. 96.07028, filed on Jun. 4, 1996, the disclosure of which is hereby expressly incorporated by reference thereto, and the priority of which is hereby claimed under 35 U.S.C.§119.

What is claimed:

1. A roller skate comprising:

a frame having an upper plate;

a plurality of skating wheels rotatably secured to said frame;

a boot connected to said upper plate of said frame, said boot including a rear portion of said boot, said rear portion being rearwardly movable with respect to said frame; and a braking device to facilitate braking of the skate by the user, said braking device comprising:

a friction element;

an activating mechanism interposed between said rear portion of said boot and said friction element, said activating mechanism including a member connected for movement in response to rearward movement of said rear portion of said boot to effect movement of said friction element into contact with the ground; and an amplification mechanism operably connected to said activating mechanism, said amplification mechanism comprising a structural arrangement to increase, at a constant ratio, a magnitude of said movement of said friction element with respect to a magnitude of said movement of said member of said activation mechanism, as said member of said activation mechanism moves.

2. A skate according to claim 1, wherein:

said amplification mechanism comprises a reducing system including:

a casing affixed to a rear portion of said frame, said casing having an internal surface;

a fixed rack secured to said internal surface of said casing;

a movable rack secured to said friction element, said movable rack being housed in said casing and facing said fixed rack; and a driving pinion interposed between said fixed rack and said movable rack, said driving pinion being rotatably secured to said activating mechanism and movable in translation with said member of said activating mechanism, said movement of said friction element being driven by said translation of said pinion and said member of said activating mechanism.

3. A skate according to claim 2, wherein:

said casing has four walls, said fixed rack and said movable rack being positioned on internal surfaces of first and second opposing walls of said four walls;

a pair of elongated guiding openings extend through respective ones of third and fourth opposing walls of said four walls, said third and fourth walls being perpendicular to said first and second walls;

said reducing system of said amplification mechanism further comprising an axle having an axis extending through said pair of elongated guiding openings, said axle being connected to said activation mechanism, said driving pinion being rotatably mounted along said axis of said axle.

4. A skate according to claim 3, wherein:

said casing further includes a closed upper portion; and said activation mechanism further comprises a U-shaped fork connected to said member of said activation mechanism, said U-shaped fork comprising a substantially horizontal arm externally overlapping said closed upper portion of said casing, said U-shaped fork further comprising a pair of arms having rotation bearings, said axle of said driving pinion being connected to said rotation bearings.

5. A skate according to claim 4, wherein:

said activation mechanism further comprises an elastic return member interposed between said substantially horizontal arm of said U-shaped fork and said closed upper portion of said casing, said elastic return member facilitating a return movement of said member of said activation mechanism and said friction element after braking.

6. A skate according to claim 5, wherein:

said elastic return member is a compression spring.

7. A skate according to claim 5, wherein:

said member of said activation mechanism extends along a first longitudinal axis;

said elastic return member extends along a second longitudinal axis, said second longitudinal axis being offset, with respect to said first longitudinal axis, in a direction toward said rear portion of said boot to facilitate support of said member of said activation mechanism against said rear portion of said boot.

8. A skate according to claim 2, wherein:

said movement of said friction element extends between an upper inactive position and a lower braking position;

said casing further includes an open lower portion;

a support plate is connected to said movable rack, said support plate having a surface area at least equal to a surface area circumscribed by of a cross section of said open lower portion of said casing, said plate being in abutment with said lower portion of said casing in said upper inactive position of said friction element.

9. A skate according to claim 2, wherein:

each of said fixed rack and said movable rack include a series of successively arranged teeth, each of said teeth extending in a determinate direction; and said driving pinion consists of a single drum having a constant diameter periphery and a series of successive teeth, each of said successive teeth extending in a direction parallel to said teeth of said movable rack and said teeth of said fixed rack.

10. A skate according to claim 2, wherein:

said driving pinion comprises two end portions and a central portion between said two end portions, each of said two end portions and said central portion having respective teeth, said teeth of said two end portions being equal, said central portion of said driving pinion having a diameter reduced with respect to diameters of said two end portions;

said central portion of said driving pinion cooperating with a corresponding portion of said fixed rack, and said end portions cooperating with corresponding portions of said movable rack, to obtain a greater reduction ratio than a reduction ration obtained with a pinion having a single toothing and a constant diameter.

11. A skate according to claim 1, wherein:

said boot comprises a shell;

said rear portion of said boot is connected to said shell by journalled connections.

12. A skate according to claim 1, wherein:

the skate is an in-line roller skate, whereby said plurality of skating wheels are rotatably successively arranged with respect to said frame between a front to a rear position.

13. A roller skate comprising:

a frame;

a plurality of skating wheels rotatably secured to said frame;

a boot connected to said upper plate of said frame, said boot including a rear portion of said boot, said rear portion being rearwardly movable with respect to said frame; and a braking device to facilitate braking of the skate by the user, said braking device comprising:

a friction element;

means for activating said friction element between an inactive position, by which said friction element is spaced from the ground, to an active position, by which said friction element is in contact with the ground, said activating means being operably interposed between said rear portion of said boot and said friction element, said means including a member connected for movement in response to rearward movement of said rear portion of said boot to effect movement of said friction element toward said contact with the ground; and means for amplifying said movement of said friction element, said amplifying means being operably connected to said activating means, said amplifying means comprising means for increasing, at a constant ratio, a magnitude of said movement of said friction element with respect to a magnitude of said movement of said member of said activation means.

14. A skate according to claim 13, wherein:

said amplifying means comprises:

a casing affixed to a rear portion of said frame, said casing having an internal surface;

a fixed rack secured to said internal surface of said casing;

a movable rack secured to said friction element, said movable rack being housed in said casing and facing said fixed rack; and a driving pinion interposed between said fixed rack and said movable rack, said driving pinion being rotatably secured to said activating means and movable in translation with said member of said activating means, said movement of said friction element being driven by said translation of said pinion and said member of said activating means.

15. A skate according to claim 14, wherein:

each of said fixed rack and said movable rack include a series of successively arranged teeth, each of said teeth extending in a determinate direction; and said driving pinion consists of a single drum having a constant diameter periphery and a successive teeth, each of said successive teeth extending in a direction parallel to said teeth of said movable rack and said teeth of said fixed rack.

16. A skate according to claim 14, wherein:

said driving pinion comprises two end portions and a central portion between said two end portions, each of said two end portions and said central portion having a series of respective teeth, said teeth of said two end portions being equal, said central portion of said driving pinion having a diameter reduced with respect to diameters of said two end portions;

said central portion of said driving pinion cooperating with a corresponding portion of said fixed rack, and said end portions cooperating with corresponding portions of said movable rack, to obtain a greater reduction ratio than a reduction ration obtained with a pinion having a single toothing and a constant diameter.

17. A skate according to claim 13, wherein:

said boot comprises a shell;

said rear portion of said boot is connected to said shell by journalled connections.

18. A skate according to claim 13, wherein:

the skate is an in-line roller skate, whereby said plurality of skating wheels are rotatably successively arranged with respect to said frame between a front to a rear position.

19. A roller skate comprising:

a frame having an upper plate;

a plurality of skating wheels rotatably secured to said frame;

a boot connected to said upper plate of said frame, said boot including a rear portion of said boot, said rear portion being rearwardly movable with respect to said frame; and a braking device to facilitate braking of the skate by the user, said braking device comprising:

a friction element;

an activating mechanism interposed between said rear portion of said boot and said friction element, said activating mechanism including a member connected for movement in response to rearward movement of said rear portion of said boot to effect movement of said friction element into contact with the ground; and an amplification mechanism operably connected to said activating mechanism, said amplification mechanism comprising a structural arrangement to increase a magnitude of said movement of said friction element with respect to a magnitude of said movement of said member of said activation mechanism, said structural arrangement of said amplification mechanism comprising:

a casing affixed to a rear portion of said frame, said casing having an internal surface;

a fixed rack secured to said internal surface of said casing;

a movable rack secured to said friction element, said movable rack being housed in said casing and facing said fixed rack; and a driving pinion interposed between said fixed rack and said movable rack, said driving pinion being rotatably secured to said activating mechanism and movable in translation with said member of said activating mechanism, said movement of said friction element being driven by said translation of said pinion and said member of said activating mechanism.

20. A skate according to claim 19, wherein:

said boot comprises a shell;

said rear portion of said boot is connected to said shell by journalled connections.

* * * * *